United States Patent [19]

Restarick et al.

[11] 4,321,965

[45] Mar. 30, 1982

[54] SELF-ALIGNING WELL TOOL GUIDE

[75] Inventors: Henry L. Restarick, Jefferson Parish, La.; John R. Setterberg, Jr., Dallas County, Tex.

[73] Assignee: Otis Engineering Corporation, Dallas, Tex.

[21] Appl. No.: 165,636

[22] Filed: Jul. 3, 1980

[51] Int. Cl.[3] ..... E21B 31/00

[52] U.S. Cl. ..... 166/117.5; 166/240; 294/86.13

[58] Field of Search ..... 166/117.5, 117.6, 98, 166/178, 99, 240; 294/86.13, 86.16; 175/296, 305

[56] References Cited

U.S. PATENT DOCUMENTS

| | | | |
|---|---|---|---|
| 2,333,802 | 11/1943 | Lowrey | 294/86.13 |
| 2,585,303 | 2/1952 | Dumble | 294/86.13 |
| 2,643,900 | 6/1953 | McBride | 294/86.13 |
| 2,710,654 | 6/1955 | Clayton | 166/98 |
| 2,739,654 | 3/1956 | Kinley et al. | 175/305 |
| 3,054,454 | 9/1962 | Evans | 166/178 |
| 3,166,350 | 1/1965 | Richert | 294/86.13 |
| 3,664,427 | 5/1972 | Deaton | 166/313 |
| 3,735,827 | 5/1973 | Berryman | 175/296 |
| 3,900,074 | 8/1975 | Lee | 175/242 |

*Primary Examiner*—James A. Leppink

*Attorney, Agent, or Firm*—Albert W. Carroll

[57] ABSTRACT

A device for guiding the lower end of a pipe string, or the like, past an upwardly facing shoulder in a well in which rotation of the pipe string is prohibited. When the guiding device lodges on such shoulder, the pipe string is lifted and lowered a few times, this reciprocating action actuating an indexing mechanism in the guide tool and causing the lower end of the guide tool to rotate so that a slanted guide surface thereon is brought around to the point of lodging to dislodge the guide tool from the shoulder and guide the pipe string therepast.

10 Claims, 7 Drawing Figures

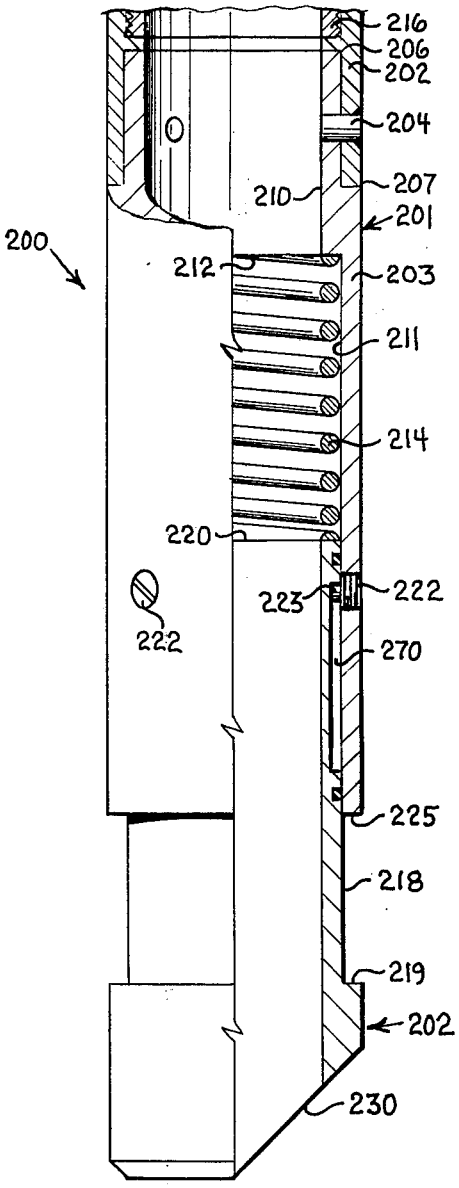
FIG. 5
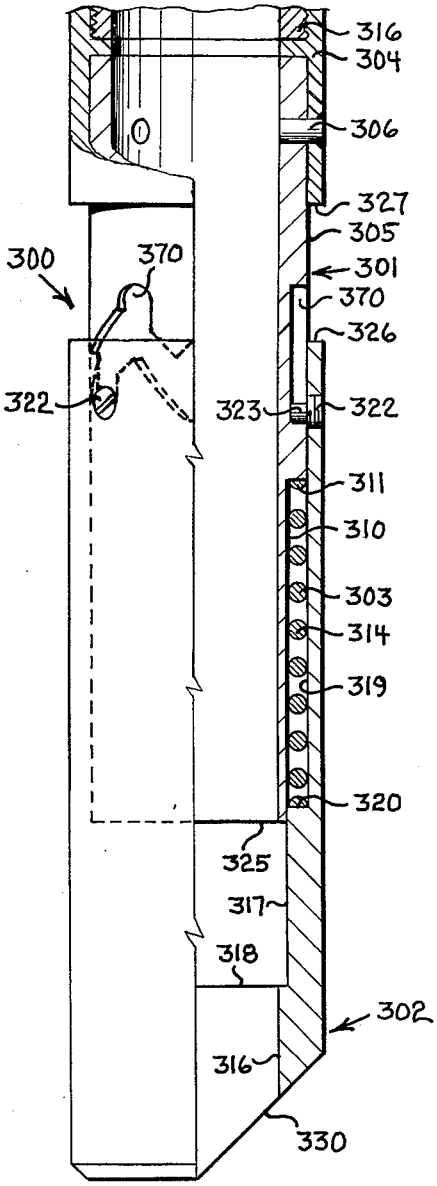
FIG. 6
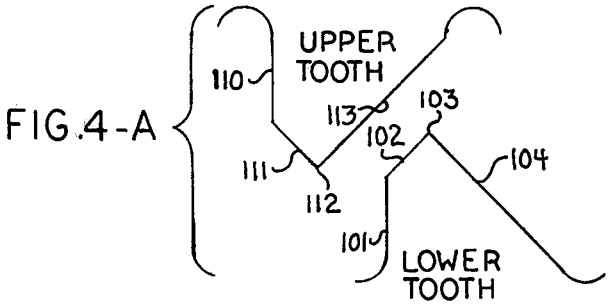
FIG. 4-A

SELF-ALIGNING WELL TOOL GUIDE

BACKGROUND OF THE INVENTION

1. Field of the Invention

This invention relates to well tools and more particularly to guides for guiding well tools into telescoping relationship with other well tools downhole.

2. Description of the Prior Art

Oftentimes it becomes necessary to lower a well tool into a well on a pipe string and insert such well tool in the bore of another well tool already in the well. For instance, a packer seal nipple might be lowered on a string of well tubing for installation in the bore of a well packer which was installed in the well earlier. In another instance, a fishing tool might be run in the well on a fishing pipe string for insertion in the bore of a portion of pipe string (fish) which has been, through mishap or inadvertence, lost in the well bore.

Under good conditions little difficulty is encountered in inserting the well tool downhole. On the other hand, great difficulty is encountered in making the insertion if the well tools to be mated are not or cannot be provided with suitable and efficient guide surfaces. But, probably the most trouble of this nature develops in well bores which are crooked or slanted. Even if a well bore were as perfectly straight and as vertical as a plumbline, a pipe string suspended therein would not remain centered, but would almost assuredly be in contact with the wall of the well bore at most places and particularly at the lower end of such pipe string. Often a plurality of pipe strings will be run simultaneously into a well as when completing multiple wells for producing from multiple zones. Such multiple pipe strings should definitely not be rotated in the well, for to do so would almost assuredly result in damage thereto and very likely require replacement of at least a part of the equipment at great expense and loss of time.

Tubular well tools, such as packer seal nipples and tail pipes cannot always be provided with a bullet-nosed guide for easy entry, but must be open ended, for instance, for running tools therethrough. Such open ended tools are subject to lodge atop the packer or fish. This is especially true of the packer which because of its structure is centered in the well. When the seal nipple approaches the packer and is sliding along the wall of the well bore, it is almost sure to lodge.

In the past, such well tools have had a guide surface formed thereon by cutting off the lower end of the tool at a slant of about 45 degrees. Such slanted guide surfaces are often termed "muleshoes." A common form of guide surface is provided by cutting off a portion of the bottom of the well tool in such manner that the cutting plane (slanted about 45 degrees) intersects the longitudinal axis at or very near the bottom of the well tool. This latter form is particularly suited for those cases where the running-in pipe string can be rotated should the well tool lodge atop the packer, or the like. Rotation of the guide will soon bring the slanted guide surface around to the point of interference and will cam or guide the well tool past the shoulder upon which it has been lodged so that the well tool will readily enter the bore of the packer, or the like.

Examples of well tool guides with slanted guide surfaces appear in the Composite Catalog of Oilfield Equipment and Services, 1970–71 Edition, at pages 3800, 3805, and 3806. Such guides must be rotated by turning the running-in pipe string when they lodge in the well as before explained.

Applicants are not aware of any well tool guide which is rotated by merely manipulating the running-in pipe string vertically, that is, by repeatedly picking up the pipe string when the guide lodges and then lowering it again until the guide either lodges or enters the bore sought to be entered.

Applicants are aware of certain prior art showings of devices which translate longitudinal reciprocal movement into rotational movement. Examples of such structures are found in the following U.S. Pat. Nos.:

2,739,654
3,735,827
3,054,454
3,900,074
3,664,427

U.S. Pat. No. 2,739,645 to M. M. Kinley et al. discloses a pin and cam slot arrangement for causing a longitudinally directed jarring impact to impart a rotational force for loosening a threaded connection in a well.

U.S. Pat. No. 3,054,454 to R. T. Evans discloses a pin and slot arrangement on a running tool to aid in setting a bridge plug, or the like, in a well. (See FIGS. 2, 3, and 4.) Reciprocal longitudinal movement of an arbor having a slot running thereabout in a zig-zag manner relative to a pin engaged in the slot provides rotational movement necessary to operate the J-slot on the bridge plug so that it can be set in place in the well bore.

U.S. Pat. No. 3,664,427 to T. M. Deaton discloses a pin and slot arrangement in which a valve having a zig-zag slot encircling its outer surface is reciprocable within a housing having a pin engaged in the zig-zag slot. As the valve is reciprocated, the pin progresses around the zig-zag slot and alternately allows the valve to go on seat and be locked off seat.

U.S. Pat. No. 3,735,827 to William O. Berryman discloses a pin and slot arrangement for controlling the action of a downhole fishing jar.

U.S. Pat. No. 3,900,074 to George W. Lee discloses a sand removal tool including telescoping sections adapted for relative longitudinal movement accomplished by manipulation of a cable swivelly attached thereto by which the tool is lowered into a well. The inner telescoping member has a bit on its lower end while near its upper end it has a pair of lugs which project outwardly into engagement with a pair of opposed helical grooves inside the outer member. Slacking off on the cable causes the outer member to rotate as it descends, and when its lower end pacts against an external shoulder on the bit attached to the inner member, the bit is caused to rotate due to the rotational inertia of the outer member, the impact shoulders having clutch means to limit slippage therebetween. Thus, the entire tool is caused to rotate.

None of the prior art patents discussed above solve the problem of guiding well tools into bores such as packer bores, receptacles, and the like. The well tool guides with muleshoes or slanted guide surfaces such as those shown in the Composite Catalog, mentioned hereinabove, work well provided the pipe string on which they are run can be rotated.

The present invention overcomes the problems and shortcomings discussed above by providing a well tool guide for guiding well tools into the bores of packers, or the like, on which such well tools are likely to lodge and where such well tools, for one reason or another, cannot be rotated by rotating the running-in pipe string from the surface.

SUMMARY OF THE INVENTION

The present invention is drawn to an improved well tool guide comprising a pair of telescoping members mounted for limited relative longitudinal movement, means tending to extend the telescoping members, and coengageable means on the telescoped members for indexing or rotating one of the members relative to the other as a result of relative longitudinal movement therebetween, the lower of the pair of members having a slanted guide surface on its lower end, whereby when the well tool guide lodges on the upper end of a downhole packer, for instance, the running-in pipe string is raised and lowered a few times to impart rotation to the lower member to bring the slanted guide surface around to the point where it will guide the well tool into the packer bore.

It is therefore one object of this invention to provide an improved well tool guide having a lower end portion with a slanted guide surface which can be rotated by reciprocating the running-in pipe string to dislodge the well tool guide and cause it to enter the bore of a packer, or the like.

Another object is to provide a well tool guide of the character set forth having a pair of telescoping reciprocable members with coengageable means for utilizing relative longitudinal movement to produce relative rotational movement for rotating the guide to a position where a slanted guide surface on its lower end will dislodge the device from atop a packer, or the like, and will guide it into the bore thereof.

A further object is to provide such a well tool guide having biasing means for moving its telescoped members to extended length.

Another object is to provide such a well tool guide wherein a coil compression spring mounted between the telescoped members biases them toward extended position.

Another object is to provide such a well tool guide having coengageable pin-and-slot means on the telescoped reciprocable members for rotating one telescoped member relative to the other.

Another object is to provide a well tool guide of the character set forth wherein the pin is carried by one of the telescoped reciprocable members and the other member has a zig-zag slot engaged by the pin such that each reciprocation of the telescoped members indexes one of the members relative to the other by a fraction of a turn to produce incremental relative rotation.

Another object is to provide a well tool guide wherein the telescoping members are provided with abutting surfaces to limit relative longitudinal movement.

A further object is to provide such a well tool guide having seal means protecting the pin-and-slot mechanism thereof from entrance of abrasive particles, detritus, or the like, thereinto and to prevent escape of lubricants therefrom.

Another object is to provide such a well tool guide with safety shear pin means which is releasable under application of a predetermined tensile load and which can be sheared should the guide become stuck in the well, permitting the running-in pipe string to be retrieved.

Other objects and advantages will become apparent from reading the description which follows and studying the accompanying drawing wherein:

BRIEF DESCRIPTION OF THE DRAWING

FIG. 4-A is a view similar to FIG. 4 showing one upper and one lower tooth of the zig-zag operating slot of FIG. 4 drawn to a larger scale;

FIG. 5 is a longitudinal sectional view of an alternate form of the invention; and FIG. 6 is a longitudinal sectional view of another alternate form of the invention.

DESCRIPTION OF THE PREFERRED EMBODIMENTS

Figure 1:
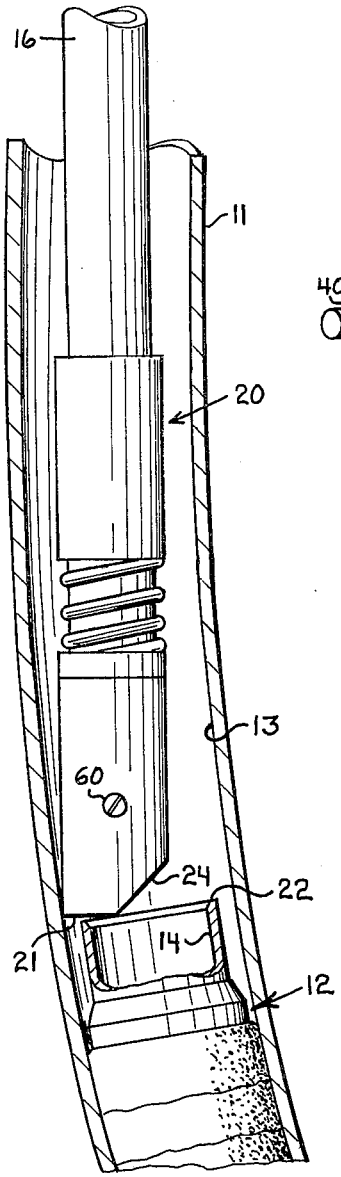
FIG. 1 is a fragmentary longitudinal sectional view with some parts broken away showing the well tool guide of this invention lodged atop a well packer in a well.

Referring now to FIG. 1 of the drawing, it will be seen that a well casing is indicated by the numeral 11 and that it is not at all straight but is curved. A well packer 12 is disposed in the bore 13 of the casing 11. The bore 14 of the packer 12 is unoccupied. A pipe string 16 such as a string of well tubing, or the like, has been lowered into the well and a well tool guide device 20 constructed in accordance with this invention is carried on the lower end of the pipe string 16 to guide the same into the bore 14 of the packer 12.

As shown in FIG. 1, the well tool guide has lodged atop the packer and can, for the time being, go no further. It is easy to see that the lower end surface 21 of the well tool guide 20 cannot be moved past the upper end surface 22 of the packer because the crooked casing causes the guide device to be forced off center as shown.

It is likewise easy to see that if the guide device 20 is rotated about 180 degrees, its slanted guide surface 24 will be brought around to the region of interference where the device is now lodged and will readily guide the device 20 and pipe string 16 into the packer bore 14 because the lower end surface 20 of the guide device will no longer interfere and because the slanted guide surface 24 is in position to cam the device away from the casing wall and away from the packer wall and into the packer bore.

Rotation of the lower end of the guide device in order to stab the pipe string into the bore of the packer is readily accomplished with the device 20 in a manner soon to be described and without rotating the pipe string 16.

Figure 2:
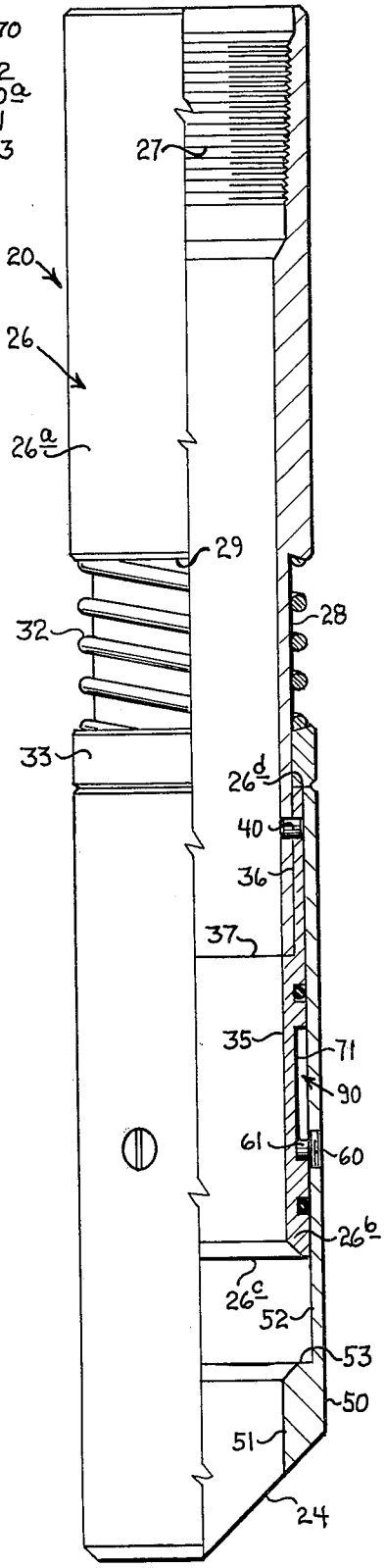
FIG. 2 is a longitudinal sectional view showing a device constructed in accordance with this invention.

Referring now to FIG. 2, the well guide tool 20 is seen to include a body 26 comprising upper body section **26*a* having thread means 27 at its upper end for attachment to a packer seal nipple or string of pipe 16, or other suitable string, and a lower body section 26*b*. The lower portion of upper body section 26*a* is reduced in outside diameter as at 28 to provide a downwardly facing shoulder 29 and to accommodate a coiled compression spring 32 and a ring 33** which are slidably mounted thereon.

The lower body section 26b has its bore 35 enlarged as at 36 to receive the reduced lower end of upper body section 26a and providing an upwardly facing internal annular shoulder 37 for limiting downward movement of the upper body section thereinto. Shear pin means comprising at least one shear pin 40 is disposed in aligned apertures in the walls of the two body sections to maintain them assembled, as shown, but which will fail at a predetermined tensile load should the lower portion of the device become severely stuck in a well thus allowing the upper portion of the device to be withdrawn from the well with the pipe string 16. A plurality of shear pins can be employed, if desired, each occupying a set of aligned apertures as does the shear pin 40.

The tensile load at which the shear pin means fails is determined largely by the material from which the shear pins are made, their size, and the number of shear pins employed. In the lower body section 26b, seen in FIG. 3, provision for up to three shear pins is evident. Not all of the shear pin holes need be occupied by shear pins.

A guide member 50 has a bore 51 which is counterbored as at 52 from its upper end to provide an internal upwardly facing shoulder 53 which limits the distance which the counterbore 52 can be telescoped over the body 26.

At least one screw 60 is installed in a suitable threaded aperture of the guide member 50 as shown and has a pin portion 61 thereon which projects inwardly and is engaged in the annular zig-zag operating slot 70. The screw 60 is installed with any suitable thread locking compound such as LOC-TITE on its threads and is screwed inwardly in the threaded aperture of the guide member 50 until the inner end thereof presses against the floor 70a of the zig-zag operating slot 70, then the screw is backed out enough to assure that the pin will not bind in the slot. After the LOC-TITE compound has hardened completely, the protruding portion of the screw is ground off flush with the outer surface of the guide member.

LOC-TITE is the trade name of a well-known thread sealing compound which is an anerobic material which hardens when air is excluded therefrom as when it is placed on threads which are then intimately engaged. This compound softens at elevated temperatures so that threads locked by it can be unscrewed. LOC-TITE thread locking compound is a product of and available from LOC-TITE Corporation, Newington, Conn.

The lower body section 26b can, if desired, be provided with an external annular groove or recess both above and below the operating slot 70 to receive a pair of wiper rings or seal rings such as rings 69 which will engage the inner wall of bore 52 of the guide member to retain lubricant in the region of slot 70 and, at the same time, exclude foreign material and abrasive particles therefrom.

Figure 3:
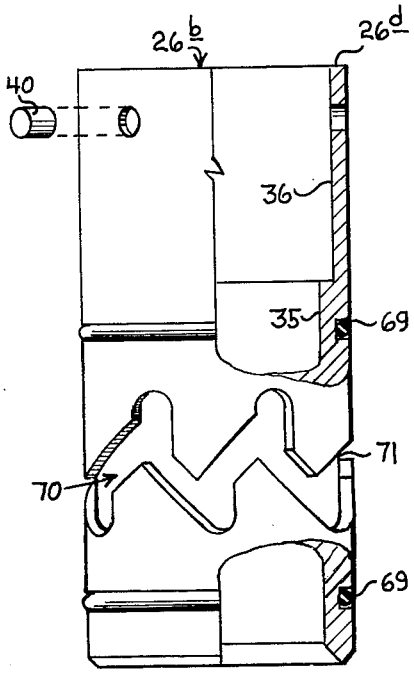
FIG. 3 is a side view of the lower body section of the device of FIG. 2 showing its external annular zig-zag operating slot.

The annular zig-zag operating slot or groove 70 is formed in the outer surface of lower body section 26b as is clearly seen in FIG. 3. The structure of the slot 70 is better seen in FIG. 4 which shows a development thereof. The slot 70 has a floor 70a and lower and upper side walls 71 and 72, respectively. The slot 70 provides a guideway through which the pin 61 of screw 60 travels as the guide member 50 is reciprocated relative to the body 26.

The lower wall 71 of the slot 70 as seen in FIG. 3 defines six lower pin pockets adapted to receive the pin 61 in sequence as the pin successively reaches its lower limit of travel in the slot during cycling of the device. These lower pin pockets are indicated by numerals 73, 74, 75, 76, 77, and 78 and are circumferentially spaced about the lower body section at 0, 60, 120, 180, 240, 300, and 360 degrees. Adjacent lower pin pockets are separated by upwardly projecting lower teeth 86, 87, 88, 89, 90, and 91. Each such lower tooth forms a portion of the lower wall 71 of the slot 70. It is clearly seen in FIG. 4-A that the wall of each lower tooth rises vertically on its left side as at 101, then turns abruptly toward the upper right to provide a guide wall 102. The wall then turns abruptly toward the lower right leaving a point 103 and forming a cam wall 104 which leads to the next pin lower pocket.

Figure 4:
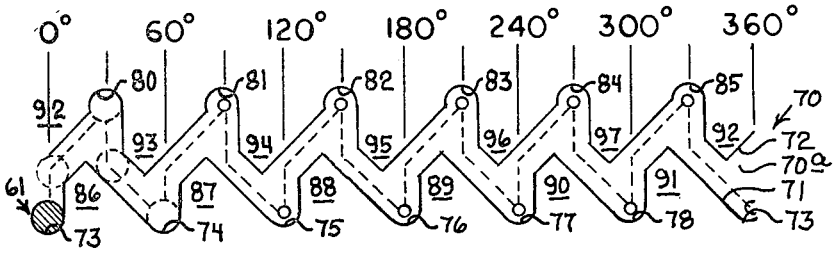
FIG. 4 is a development view of the zig-zag operating slot of the tubular member of FIG. 3.

The upper wall 72 of zig-zag operating slot 70 is similarly formed. The upper-wall 72 has six pin pockets 80–85 which correspond to the lower pin pockets but are staggered relative thereto. The upper pin pockets are separated by downwardly projecting teeth 92–97 as shown, which are shaped like the lower teeth 86–91 and which are circumferentially spaced about the body at 30, 90, 150, 210, 270, and 330 degrees. Each such tooth has a vertical wall portion 110, a slanted guide portion 111, a point 112, and a slanted cam portion 113, all as shown in FIG. 4.

Thus, as the guide member 50 is reciprocated relative to the body 26 and the zig-zag operating slot 70 carried on the lower body section 26b, the pin 61 of the guide member moves along the slot 70 to rotate the guide relative to the body. For instance, the pin 61 may begin in lower pin pocket 73 (at extreme left in FIG. 4) and, as the guide is forced up relative to the body, the pin 61 moves up along vertical wall portion 101 (see FIG. 4-A) of lower tooth 86 and follows along the path indicated by the dotted line until it engages cam surface 113 of upper tooth 92, then progresses upwardly and to the right therealong until it comes to rest in upper pin pocket 80. Similarly, when the guide member subsequently moves down, the pin 61 will move down along vertical wall portion 110 of upper tooth 93 until it engages cam surface 104 of lower tooth 86 and will slide therealong until it comes to rest in pin pocket 74. Thus, in one up-and-down cycle of the pin, it has progressed from pin pocket 73 to pin pocket 74, and has caused the guide member to be rotated 1/6 turn or 60 degrees.

In a similar manner, as the guide member 50 is cycled or reciprocated relative to the body 26, the pin 61 will progress upward to pocket 81, downward to pocket 75, then to pockets 82, 76, 83, 77, and so on in sequence and indefinitely so long as the guide member is reciprocated with sufficient stroke to cause the pin to follow the slot.

Reciprocation of the guide member 50 begins when it comes to rest on an obstruction, such as when it lodges atop a well packer as shown in FIG. 1, and sufficient weight is placed upon it to compress the spring 32 and move the body 26 downwardly relative to the guide member 50. This downward relative movement of the body is arrested when the lower end 26c of the lower body section 26b engages the internal upwardly facing stop shoulder 53 in the guide member. At this time the pin 61 will occupy an upper pin pocket, say pocket 80, but there will be no load on the pin since the load is borne by stop shoulder 53 just mentioned. Thus pin 61 cannot be sheared or damaged by the weight of the pipe string 16.

When the running-in pipe string is lifted sufficiently, the spring 32 will force the guide member downward relative to the body, and pin 61 will move down until it occupies pin pocket 74. Although downward movement of the guide member is limited by the pin 61 engaging the bottom of the pin pocket, ring 33 which, being biased by the spring 32, forces the guide member downwardly but only until the ring is stopped by its engagement with the upper end surface 26*d* of the lower body section 26*b*. This occurs just before the pin 61 reaches the bottom of the pocket. Thus, the pin 61 has to support only the weight of the guide member and does not bear the load of spring 32.

Since each cycle of the guide member results in it being rotated 1/6 turn, a full turn will result from only six cycles. Thus, in less than six cycles the guide should enter the packer bore. In the condition shown in FIG. 1, no more than three cycles should be required to gain entrance into the packer since not more than 180 degrees of rotation should be required.

While the well tool guide 20 has been illustrated and described as requiring six cycles of the guide members to rotate it one full turn, other ratios could be used if desired. For instance, if the diameter of the lower body section 26*b* in which the zig-zag slot 70 is formed is quite large, more cycles per turn may be desirable; if quite small, perhaps fewer cycles per turn may be preferred. This, of course, is based upon maintaining a stroke of reasonable length.

Thus, it has been shown that a well tool guide 20 has been provided which is useful in guiding well tools into the bores of packers, lost pipe, and the like, which are located downhole in wells, the well tool guide 20 being lowered into the well on a running-in pipe string which for some reason cannot be rotated to gain entrance into such bore. For instance, the well casing may be so crooked that turning the pipe at the surface may not necessarily turn it at its lower end and hence may result in over-torquing a portion thereof and causing serious and costly damage. Also, this tool guide is useful in multiple wells where it may be necessary to run multiple pipe strings simultaneously. In such case, the pipe strings cannot be rotated, for to do so may twist them around one another and cause serious and costly damage and loss of time.

It has also shown that when well tool guide 20 is lowered into a well and it lodges atop a packer, for instance, such that merely lowering of the pipe string will not cause the guide to enter the packer bore, it is only necessary to lift and lower the running-in pipe a few times to cause the guide member 50 to rotate to bring its slanted guide around to the point of interference and cam or guide the tool into the packer bore without endangering the integrity of the running-in pipe string.

A second embodiment of this invention is shown in FIG. 5 and is indicated generally by the numeral 200.

The well tool guide 200 comprises a body 201 and a guide member 202 disposed in telescoping relationship for limited longitudinal reciprocable movement. It performs the same function as does the well tool guide device of FIGS. 1–4 and performs it in exactly the same manner.

The body 201 comprises an upper body member 202 and a main body member 203 telescoped together and secured with a safety shear pin 204 disposed in aligned lateral apertures in the two members as shown. Although the shear pin 204 is shown to be welded in place, it could be screwed in or could be a drive fit, or otherwise suitably retained.

The guide member 202 has a bore 216 which is approximately the size of bore 210 of the main body 203. The guide member 202 has its outside diameter reduced as at 218 to provide an upwardly facing shoulder 219. Near its upper end, the guide member 202 has zig-zag operating slot 270 formed in its exterior surface, and this slot may be formed exactly like the zig-zag operating slot 70 of the embodiment of FIGS. 1–4 before described.

The guide member 202 has its upper end telescoped into the lower end of main body section 203, its upper end surface 220 engaging the lower end of spring 214. With the guide member 202 pushed upwardly to compress the spring 214, screws 222 are installed in the threaded apertures of the main body section after LOC-TITE thread sealant has been applied to its threads as before explained. The inner pin portions 223 of the screws, of course, engage the zig-zag slot. The screws are tightened, backed out a little to provide clearance, and the LOC-TITE compound allowed to set, after which the protruding portion of the screw is ground flush with the exterior of the body.

The spring thus biases the guide member downwardly toward the extended position illustrated in FIG. 5. Downward movement of the guide member 202 is limited by the engagement of pin 223 in an upper pin pocket of operating slot 270.

Guide member 202 can be pushed up into main body only until its upwardly facing external annular stop shoulder 219 engages the lower end face 225 of the main body. At this time the pin 223 will occupy a lower pin pocket of the slot 270 but should not be bearing on the bottom thereof. Thus, setting the weight of the pipe string 216 down on the tool will engage the shoulders 219 and 225 but will not damage pin 223.

When the well tool guide 200 is run into a well on a pipe string such as string 216 and the guide lodges as on the top of a well packer, the pipe string is lifted and lowered a few times (as was the device 20) until the pin 223 traveling around slot 270 in the manner before explained rotates the guide member sufficiently to bring its slanted guide surface 230 around to the point of interference whereupon the slanted guide surface will cause the device to be cammed or guided into the packer bore, all as explained before in conjunction with the first embodiment.

Should the lower portion of device 200 become severely stuck in the well, a tensile load sufficient to shear the pin 204 is applied to the pipe string, and the pipe string is then retrieved from the well, leaving the main body section 203, guide member 202, and spring 214 in the well.

A third embodiment of this invention is illustrated in FIG. 6 and is indicated generally by the numeral 300.

Well tool guide 300 comprises a body 301 and a guide member 302 telescoped together with a spring 303 disposed therebetween.

The body 301 comprises an upper extension 304 and a main body section 305 which are connected together in telescoped relation and secured by a shear pin 306 which may be secured by any suitable means but is shown as being secured by welding to the upper extension 304. Upper extension 304 is threaded for attachment to running-in pipe string 316.

Main body member 305 is provided with a zig-zag operating slot 370 formed in its exterior surface intermediate its ends. This slot is formed like the slot 70 of the first embodiment 20 which is described hereinabove and illustrated in FIGS. 3 and 4. Slot 370, like slot 270 of the second embodiment 200, performs the same function as does the slot 70 of the first embodiment 20 and performs that function in the same manner.

The lower portion of the main body 305 is reduced in outside diameter as at 310 providing a downwardly facing external annular shoulder 311. A coiled compression spring 314 is disposed about this reduced diameter portion 310 and has its upper end engaged with downwardly facing shoulder 311 of the body.

Guide section 302 has a bore 316 which is enlarged at 317 providing an internal upwardly facing shoulder at 318. Bore 317 is further enlarged at 319 providing an upwardly facing shoulder 320 which bears against the lower end of spring 314 when the upper end of the guide member 302 is telescoped over the lower end of the main body 305 as shown. With the spring 314 compressed, screws 322 having pins 323 on their inner ends are coated with LOC-TITE compound (on the threads only) and threaded into the threaded apertures in the guide member until the inner ends of the pins engage the bottom of zig-zag operating slot 370, after which they are backed out just a little to provide clearance and are left until the LOC-TITE compound hardens. After this, the outer ends of the screws are ground flush with the outer surface of the guide member 302.

The reduced portion 310 of the main body 305 passes through the spring 314, and its lower end telescopes into enlarged bore 317 of the guide member 302. Since this reduced portion of the main body is of relatively thin section, it is preferable that its lower end 325 not limit upward movement of the guide member 302 relative thereto unless such movement be also limited by the engagement of the upper end 326 of the guide member with the lower end 327 of the upper extension 304.

Guide member 302 is provided with a slanted guide surface 330 in the same manner as the two preceding embodiments 20 and 200 were provided with slanted guide surfaces.

The device 300 is used in the same manner as is the device 20. It is attached to the lower end of a well tool such as a packer seal nipple or an inside fishing tool, or the like, and lowered into a well to guide the well tool into the bore of such downhole packer or into the bore of such section of pipe lost downhole. Should the device 300 lodge atop the packer or lost pipe, the device can be readily dislodged by lifting and lowering the pipe string a few times to repeatedly apply weight to the device to cause the pin 323 thereof to follow the operating slot 370 and rotate the guide member to bring its slanted guide surface into position where it will dislodge the device from atop the packer or lost pipe. Should the device become stuck, the pipe string can be lifted, causing the pin 306 to be sheared, permitting the pipe string to be retrieved.

Thus, it has been shown that this invention solves the problem of inserting well tools into restricted bores downhole in wells, such restricted bores being the bores of downhole packers or the bores of lost pipe strings, or the like, especially in those cases where for some reason the pipe string on which the device of this invention is run cannot or should not be rotated as would be necessary with guides or muleshoes which have slanted guide surfaces such as those illustrated in the Composite Catalog mentioned above. Thus, also, it has been shown that the devices embodying this invention fulfill all of the objects set forth hereinabove. Further, it has been shown that the devices of this invention are easy to use and simple to operate.

The foregoing description and drawings of the invention are explanatory and illustrative only, and various changes in sizes, shapes, materials, and arrangements of parts, as well as certain details of the illustrated construction, may be made within the scope of the claims without departing from the true spirit of the invention.

We claim:

1. A tool guide, comprising:
   a. a tubular body having means on its upper end for attachment to a tool string;
   b. a guide member having its upper end telescopingly engaged with said tubular body and reciprocable relative thereto, said guide member having an inclined guide surface at its lower end;
   c. coengageable means on said tubular body and said guide member for indexing said guide member about its longitudinal axis in response to reciprocal movement between said body and said guide member;
   d. means biasing said guide member toward extended position; and
   e. means on said body and said guide member limiting longitudinal movement between said body and said guide member.

2. The device of claim 1, wherein said means for limiting longitudinal movement includes:
   a. first stop means on said body; and
   b. second stop means on said guide member engageable with said first stop means on said body.

3. The device of claim 2, wherein said biasing means is a coil spring engaged between said body and said guide member.

4. The device of claim 3 including means sealingly engaged between said body and said guide means to exclude foreign material from said indexing means.

5. The device of claim 4 wherein said body comprises first and second tubular body members secured together in coaxial relationship by means releasable responsive to a predetermined tensile load, and said spring has one of its ends engaging said second body member and the other of its ends engaging said guide member.

6. The device of claim 5 wherein said releasable means comprises at least one shear pin disposed in aligned apertures formed in the walls of said first and second body members.

7. The device of claim 1, 2, 3, 4, 5, or 6 wherein said indexing means comprises:
   a. annular zig-zag operating slot means formed in the exterior surface of said body, said annular operating slot having upper and lower edges with alternately projecting teeth staggered about said body defining a plurality of pin receiving pockets therebetween, said teeth each having a point and lateral cam surfaces; and
   b. a pin carried by said guide member and engaged in said annular operating slot, said pin being alternately engageable with said cam surfaces of said upper and lower teeth when said guide member is reciprocated relative to said body to impart relative rotational movement to said guide member.

8. The device of claim 7 wherein said sealing means includes:
   a. a pair of annular seal ring grooves formed in the exterior of said body and longitudinally spaced one above, and one below, said operating slot; and b. a pair of resilient seal rings disposed one in each of said seal ring grooves engageable with the inner wall of said guide member to exclude foreign matter from said indexing means.

9. A tool guide, comprising:

a. a first tubular body member having means on its upper end for attachment to a tool string, the lower portion of said first tubular body member being reduced in outside diameter and providing a downwardly facing shoulder intermediate its ends;

b. a second tubular body member having an annular zig-zag operating slot formed in its exterior surface, the walls of said operating slot providing cam surfaces, the upper portion of the bore of said second tubular member being enlarged and providing an internal upwardly facing shoulder intermediate its ends, said second body member adapted to receive the lower reduced diameter portion of said first body member in its enlarged bore;

c. shear pin means disposed in aligned apertures formed in the walls of the first and second body members to secure the same together, said shear pin means being adapted to release said body members from each other in response to a predetermined tensile load;

d. a ring slidably mounted on the reduced diameter portion of said first body member, downward movement of said ring being limited by engagement of said ring with the upper end of said second body member;

e. spring means on said first body member having one end engaged with said downwardly facing shoulder thereon and its other end engaged with said ring;

f. a guide member having a slanted guide surface at its lower end, said guide member being telescoped over said second body member and having at least one pin projecting inwardly and engaged in said operating slot of said second body member, the upper end of said guide member being engageable with said ring, said guide member having an internal upwardly facing shoulder normally spaced from the lower end of said second body member and being engageable therewith to limit upward movement of said guide member relative to said body, said spring biasing said guide member downwardly, said pin advancing along said operating slot to rotate said guide member relative to said body as a result of said guide member being reciprocated relative thereto.

10. The device of claim 9, including:

resilient seal rings disposed between said second body member and said guide member above and below said zig-zag operating slot to exclude foreign material therefrom.

* * * * *